US010314328B2

(12) United States Patent
Soo et al.

(10) Patent No.: US 10,314,328 B2
(45) Date of Patent: Jun. 11, 2019

(54) APPARATUS FOR THE PRODUCTION OF A CAST WEB OF HOMOGENIZED TOBACCO MATERIAL

(71) Applicant: PHILIP MORRIS PRODUCTS S.A., Neuchatel (CH)

(72) Inventors: Siew Hock Soo, St-Sulpice (CH); Raffaele Pozzi, Limbiate (IT); Fabio Conti, Albairate (IT)

(73) Assignee: Philip Morris Products S.A., Neuchatel (CH)

( * ) Notice: Subject to any disclaimer, the term of this patent is extended or adjusted under 35 U.S.C. 154(b) by 169 days.

(21) Appl. No.: 15/526,008

(22) PCT Filed: Dec. 16, 2015

(86) PCT No.: PCT/EP2015/079963
§ 371 (c)(1),
(2) Date: May 11, 2017

(87) PCT Pub. No.: WO2016/096964
PCT Pub. Date: Jun. 23, 2016

(65) Prior Publication Data

US 2017/0303579 A1 Oct. 26, 2017

(30) Foreign Application Priority Data

Dec. 16, 2014 (EP) ..... 14198174

(51) Int. Cl.
*A24B 3/14* (2006.01)

(52) U.S. Cl.
CPC ..... *A24B 3/14* (2013.01)

(58) Field of Classification Search
CPC . A24B 3/14; A24B 15/00; F26B 17/00; F26B 17/28; F26B 17/08
(Continued)

(56) References Cited

U.S. PATENT DOCUMENTS 2,769,734 A 11/1956 Bandel
3,101,722 A * 8/1963 Mettitt ..... F26B 17/284 131/304
(Continued)

FOREIGN PATENT DOCUMENTS

CN 85104502 12/1986
CN 1403036 3/2003
(Continued)

OTHER PUBLICATIONS

International Search Report and Written Opinion for PCT/EP2015/079963 dated Mar. 22, 2016 (11 pages).
(Continued)

*Primary Examiner* — Stephen M Gravini
(74) *Attorney, Agent, or Firm* — Mueting, Raasch & Gebhardt, P.A.

(57) ABSTRACT

The invention relates to an apparatus (1) for the production of cast web of homogenized tobacco material, said casting system comprising a casting box (4) adapted to contain a slurry of said homogenized tobacco material and from which a cast web of said slurry is cast;

a first drying section adapted to dry said cast web;

a movable support to receive the cast web formed by casting said slurry from said casting box and to transport it to said first drying section;

a drum (8) adapted to move said movable support and adapted to allow heat exchange between said drum and said movable support; and first temperature control means to cool said drum so that a temperature difference between a temperature of said movable support at a position where said cast web is received onto said support from said casting box and a
(Continued)

temperature of said slurry in said casting box is comprised between about 0 degree Celsius and about 30 degrees Celsius.

15 Claims, 5 Drawing Sheets

(58) Field of Classification Search
USPC ..... 34/487
See application file for complete search history.

(56) References Cited

U.S. PATENT DOCUMENTS

| | | | | | |
|---|---|---|---|---|---|
| 3,213,858 | A * | 10/1965 | Mettitt | A24B 3/14 | 131/372 |
| 3,372,488 | A * | 3/1968 | Koch | A24B 3/04 | 131/303 |
| 3,589,032 | A | 6/1971 | Gretz | | |
| 3,883,959 | A * | 5/1975 | Neville | A24B 3/04 | 34/134 |
| 3,905,123 | A * | 9/1975 | Fowler | A24B 3/04 | 131/303 |
| 4,241,515 | A * | 12/1980 | Wochnowski | A24B 3/04 | 131/303 |
| 4,337,783 | A | 7/1982 | Hooper | | |
| 4,346,524 | A * | 8/1982 | Wochnowski | A24B 3/04 | 131/303 |
| 4,434,563 | A * | 3/1984 | Graalmann | F26B 25/22 | 131/303 |
| 4,936,920 | A * | 6/1990 | Keritsis | A24C 5/18 | 131/352 |
| 4,977,908 | A | 12/1990 | Luke | | |
| 6,032,384 | A * | 3/2000 | Fingerson | A24B 3/04 | 34/427 |
| 6,200,142 | B1 | 3/2001 | Soh | | |
| 6,216,706 | B1 | 4/2001 | Kumar | | |
| 6,485,310 | B2 | 11/2002 | Soh | | |
| 6,688,018 | B2 * | 2/2004 | Soucy | F26B 3/286 | 34/210 |
| 8,898,927 | B2 * | 12/2014 | Shan | A24B 3/18 | 34/282 |
| 2017/0303579 | A1 * | 10/2017 | Soo | A24B 3/14 | |
| 2017/0340002 | A1 * | 11/2017 | Soo | A24B 15/12 | |

FOREIGN PATENT DOCUMENTS

| | | | | |
|---|---|---|---|---|
| CN | 101433367 | | 5/2009 | |
| CN | 201846778 | | 6/2011 | |
| CN | 103750534 | | 4/2014 | |
| EP | 0565360 | | 10/1993 | |
| EP | 1055375 | | 11/2000 | |
| EP | 3232824 | B1 * | 9/2018 | A24B 3/14 |
| GB | 896933 | | 5/1962 | |
| GB | 943352 | | 12/1963 | |
| JP | 2000-125834 | | 5/2000 | |
| JP | 2000-41648 | | 9/2000 | |
| WO | WO-2016096964 | A1 * | 6/2016 | A24B 3/14 |

OTHER PUBLICATIONS

Office Action issued in China for Application No. 201580066308.9 dated Feb. 26, 2018.

* cited by examiner

APPARATUS FOR THE PRODUCTION OF A CAST WEB OF HOMOGENIZED TOBACCO MATERIAL

This application is a U.S. National Stage Application of International Application No. PCT/EP2015/079963, filed Dec. 16, 2015, which was published in English on Jun. 23, 2016, as International Publication No. WO 2016/096964 A1. International Application No. PCT/EP2015/079963 claims priority to European Application No. 14198174.6 filed Dec. 16, 2014.

This invention relates to an apparatus for producing a cast web of homogenized tobacco material. In particular, the invention relates to an apparatus for producing a cast web of homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder, are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. Less than optimal casting conditions and apparatus may lead to inhomogeneity and defects of the cast web of homogenized tobacco.

Inhomogeneity in the homogenized tobacco web may lead to difficulties in subsequent handling of the homogenized tobacco web in the production of the aerosol-generating article.

For example, inhomogeneity may lead to tearing of the web or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

There is therefore a need for a new apparatus of preparing a homogenized tobacco material, in particular for the use in a heated aerosol-generating article of the "heat-not-burn" type that is adapted to the different heating characteristics and aerosol forming needs of such a heated aerosol-generating article.

According to a first aspect, the invention relates to an apparatus for the production of a cast web of homogenized tobacco material, said apparatus comprising a casting box adapted to contain a slurry of said homogenized tobacco material and from which a cast web of said slurry may be cast; a first drying section adapted to dry said cast web; a movable support to receive the cast web formed by casting said slurry from said casting box and to transport it to said first drying section; and a drum adapted to move said movable support. According to the invention, the drum is adapted to allow heat exchange between said drum and said movable support; and the apparatus further includes first temperature control means to cool said drum so that a temperature difference between a temperature of said movable support at a position where said cast web is received onto said support from said casting box and a temperature of said slurry in said casting box is comprised between about 0 degree Celsius and about 30 degrees Celsius.

Homogenized tobacco materials are formed by mixing several ingredients with water to obtain a slurry. In a further step, a continuous web of homogenized material is created on a support by casting the slurry onto the support. It is desired that the resulting homogenized tobacco material has a relatively high tensile strength and a good homogeneity.

An important parameter of the slurry that influences the tensile strength and homogeneity of the cast web of homogenized tobacco material is its viscosity of the slurry, in particular at the time of casting of the slurry. In addition, also the density of the slurry is important for determining the end quality of the cast web, in particular before casting. A proper combination of slurry density, viscosity and homogeneity minimizes the number of defects and may increase the tensile strength of the cast web.

Another relevant process in the production of the homogenized tobacco material is the drying of the cast web, in which the level of moisture of the homogenized tobacco material changes from the slurry moisture to the finished cast web moisture, which is much less than the initial one. This process of drying is preferably optimized in order to minimize defects formations, such as bubbles or agglomerates, in the cast homogenized tobacco material. Further, where the drying process too fast or the cast web is exposed to high temperature gradients, an undesired crust on top of the cast web may form. The crust is a thin hardened layer on the top surface of the cast web that prevents the moisture in the cast web to escape from underneath the crust. When the crust forms or forms too fast, this frequently leads to the appearance of bubbles below the crust. The bubbles are a source of undesired inhomogeneity.

The slurry comprises a number of different components or ingredients. These components influence the homogenized tobacco material properties. A first ingredient is a tobacco powder blend, which preferably contains the majority of the tobacco present in the slurry. The tobacco powder blend is the source of the majority of tobacco in the homogenized tobacco material and thus gives the flavor to the final product, for example to an aerosol that is produced when heating the homogenized tobacco material. A cellulose pulp containing cellulose fibers is preferably added to the slurry in order to increase the tensile strength of the tobacco material web, acting as a strengthening agent. A binder and an aerosol-former are preferably added as well, in order to enhance the tensile properties of the homogenized sheet and promote the formation of aerosol. Further, in order to reach a certain viscosity and moisture optimal for casting the web of homogenized tobacco material, water may be added to the slurry. The slurry is mixed in order to render it as homogeneous as possible.

The slurry is then collected in the casting box, in which a pre-defined amount of slurry is preferably maintained, for example a pre-determined level of slurry within the casting box. Preferably, slurry is continuously supplied to the casting box while the slurry is cast onto a movable support to form a continuous web of homogenized tobacco material.

According to the invention, the slurry is cast across a width of a moving support, through an exit of the casting box that is formed between the moving support and a casting blade. The support moves along a longitudinal direction in order to remove the slurry from the casting box. The support may include for example a stainless steel movable belt. The support is moved by a drum which is adapted to advance the movable support. The drum is further adapted to be in thermal contact with the movable support for the cast web. Preferably, the temperature of the drum is regulated so that a desired temperature of the moving support is obtained via heat exchange between the moving support and the drum. The regulation of the temperature is such that the difference between the temperature of the slurry in the casting box and the temperature of the support is comprised between 0 degree Celsius and about 30 degrees Celsius. Preferably, the difference between the temperature of the slurry in the casting box and the temperature of the support is comprised between 0 degree Celsius and about 15 degrees Celsius. This narrow range of temperature difference prevents a thermal shock in the slurry, when the slurry is deposited onto the support. A thermal shock may cause a sudden expansion or contraction of the slurry material. This can cause defects, such as non-homogeneities or bubbles. Further, controlling the temperature of the support allows obtaining an even distribution of the temperature within the support itself. Without such an active control, the temperature at the sides of the support tends to be lower than the temperature at the center of the support. This may cause inhomogeneity in the cast web deposited onto the movable support.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering for example tobacco leaf lamina or tobacco leaf stems or blends thereof.

In addition, homogenized tobacco material may comprise a quantity of one or more of tobacco dust, tobacco fines, and other particulate tobacco by-products formed during the treating, handling and shipping of tobacco.

In the present invention, the slurry is preferably formed by tobacco lamina and stem of different tobacco types, which are properly blended. In this, the term "tobacco type" refers to one of the different varieties of tobacco. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

As mentioned above, the slurry should be as homogeneous as possible so that also its viscosity is as uniform as possible and close to a target value optimal for casting. In order to obtain a uniform viscosity, the entire amount of slurry is preferably mixed before casting.

The slurry is then transported to the casting box to fill the casting box up to a preferably pre-determined level. Preferably, the filling level of slurry in the casting box is maintained substantially constant within the casting box. The slurry flows out the casting box from an aperture realized in the bottom of the casting box, for example under the influence of gravity. Additionally, means for an active transport within the casting box may be provided, like pushers or propellers. Preferably, the casting box forms a pressurized enclosure. Preferably, control means are provided that allow control over the pressure within the casting box. In such an embodiment, the flow of slurry out of the casting box is additionally controlled by setting and maintaining the level of the internal pressure within the casting box. Preferably, the casting apparatus comprises a mixing device to mix the slurry inside the casting box. The slurry is then distributed onto the moving support through the gap that is formed between the casting blade and the moving support.

The moving support is preferably an endless belt, that is, each portion of the moving support that is at some point in time during production located below the casting box and transports the slurry to a drying station then returns to the casting location where the slurry is deposited onto the moving support. The support defines a width, which is generally bigger or similar to the width of the cast web deposited onto the moving support.

In the drying station, preferably the temperature of the cast web is raised, so that moisture inside the cast web can decrease. Preferably, the moisture of said cast tobacco material web at casting—that is, the moisture of the slurry—is between about 60 percent and about 80 percent. Preferably, the moisture of said cast web at the end of the drying is between about 7 percent and about 15 percent of dry weight of the tobacco material web. Preferably, the moisture of said homogenized tobacco web at the end of drying is between about 8 percent and about 12 percent of dry weight of the homogenized tobacco web. The moisture of the slurry at casting and at the end of the drying process is another important parameter to control as it influences the homogeneity of the homogenized tobacco web and the manufacturability of the homogenized tobacco web in subsequent production steps.

It has been found, that the ideal level of moisture of the slurry is between about 60 percent and about 80 percent. Below this preferred range, the density of the slurry at casting is such that it frequently causes the appearance of defects in the cast web. Also, a moisture level outside of this range may result in a reduced tensile strength of the cast web that may complicate efficient handling of the web of homogenized tobacco material in subsequent processing steps. Therefore, the excess moisture that needs to be removed during the drying step from the cast web is relatively high. The removal of moisture is performed preferably by exposure to a stream of drying air, wherein the drying air has a higher temperature than the temperature of the cast web. Increasing the temperature around the cast web causes also the temperature of the movable support to increase. Due to heat transfer with the environment, the temperature at the boundaries of the movable support, boundaries that include the lateral edges of the movable support, tends to be lower than in the rest of the movable support. Indeed, it has been found that the temperature at the boundaries of the support, without correction, might be up to about 5 degrees Celsius to about 15 degrees Celsius lower than the temperature in the middle of the movable support. Therefore, when the movable support from the drying station returns to the casting box to collect further slurry, the movable support may have a temperature that exceeds the temperature of the slurry. The slurry inside the casting box is preferably kept at about ambient temperature, that is, between about 15 degrees Celsius and about 30 degrees Celsius. In addition, without active correction, the movable support may frequently show a non-homogeneous distribution of the temperature along its width, such that the movable support tends to have a lower temperature at the boundaries of the movable support and a higher temperature in the center of the movable support.

Casting the slurry onto the movable support that has a non-uniform temperature distribution as described above, may result in defects appearing in the cast web. The slurry, being subjected to a non-uniform high temperature gradient might form an uneven thickness on the movable support. Defects such as bubbles may occur under these conditions. A higher thickness in the center on the movable support may develop. Further, the high temperature difference between the support and the slurry may trigger the formation of a dry thin layer on top of the cast web. This dry layer or crust, that is harder and less moisture permeable than the underlying cast web, inhibits drying of the material forming the cast web below this dry layer. This inhibition is due to the moisture trapping effect of the crust as water cannot evaporate properly through the crust. Therefore, the cast web cannot dry optimal. This may lead to waste. The dry layer additionally is prone to form cracks and thus defects into the cast web. The cracks in the crust can lead to an unintended decrease in the tensile strength of the web, increasing the likelihood of tearing of the web of homogenized tobacco material, for example during subsequent manufacturing steps.

According to the invention, in order to obtain a homogeneous cast web in which the formation of defects is minimized, a slurry having the preferred density and moisture according to the process parameters is cast through the casting box. This slurry is cast onto the movable support which is kept to a predetermined temperature by means of the same drum used to move the movable support. The drum is kept at a temperature such that a temperature difference between the temperature of the movable support at the location of slurry deposition and the temperature of the slurry in the casting box is comprised between about 0 degree Celsius and about 30 degrees Celsius by means of first temperature control means. Preferably, the temperature difference is between 0 degrees Celsius and about 15 degrees Celsius, more preferably between 0 degrees Celsius and about 7 degrees Celsius. A small temperature difference reduces the appearance of defects. Further, the "crust" or dried layer on top of the cast web caused by an excessive temperature gradient forms slower or does not form. Preferably, the temperature of the movable support at the casting box is between about 15 degrees Celsius and about 50 degrees Celsius at the slurry deposition position. Preferably the temperature of the slurry in the casting box is comprised between about 15 degrees Celsius and 35 degrees Celsius, more preferably, between about 20 degrees Celsius and about 28 degrees Celsius.

Further, an active control of the temperature of the support by means of the regulation of the temperature of the drum allows a uniform temperature distribution along the whole width of the movable support, due to the heat exchange between the drum and the support. The temperature along the whole width is substantially the same, with a tolerance of between about 2 degrees Celsius and about 15 degrees Celsius. Preferably, the slurry cast on the movable support is subjected to a uniform temperature. This allows reducing the risk of formation of inhomogeneity in the end product.

According to a preferred embodiment, the temperature of the drum and thus in turn of the movable support is regulated by means of a water cooling distributor. Preferably, the water is used to cool the drum, as the temperature of the support is generally higher than the desired temperature at casting, due to the fact that the support returns from the drying section, where the support and cast web are heated up to remove the moisture from the cast web. Water is a good and cost efficient means to maintain the temperature of an object, in this case the drum, controlled within a certain range due to the availability and high thermal capacity of water.

Advantageously, the movable support includes an endless stainless steel conveyor belt. Stainless steel is a material which allows easy heat transfer as it is a good heat conductor. At the same a stainless steel belt reduces the risk of the homogenized tobacco material to firmly attach to the support and thus allows complete and continuous removal of the cast web of homogenized tobacco after the first drying section. During the production process of the cast web, after the cast web has been at least partially dried, the cast web is removed from the movable support in order to be further processed. The cast web of homogenized tobacco is then further dried, cooled and then wound in bobbins. The endless movable support is returns to the location of the casting box so that a further slurry can be cast onto the movable support. The removal of the cast web from the support preferably takes place by means of a blade called doctoring blade. In case the cast web is firmly "glued" onto the support, the action of the doctoring blade may cause a breakage of the cast web and a machine interruption. Therefore, it is preferred that the removal of the cast web from the support is as easy as possible and the use of stainless steel as the material for the support has been found to be a preferred solution. Also, stainless steel can be machined to the low required tolerances for the casting of the web of homogenized tobacco material. This makes stainless steel a cost efficient material as a movable support.

In a preferred embodiment, the apparatus comprises second temperature control means in said first drying section. Further, the movable support defines a first and a second opposite surface, said slurry being cast onto the first surface. The second temperature control means comprises a steam generator to eject steam towards the second surface of the movable support. The drying of the cast preferably is slow and under a continuous control of the temperature and the moisture of the cast web. Advantageously this minimizes the appearance of defects and inhomogeneity in the cast web of homogenized tobacco material. The drying of the cast web takes place in a first drying section. Preferably, more than a drying section is present. Preferably, each of the drying sections is independently controlled, so that in each drying section process parameters can be set independently from the other sections. Preferably, the first drying section includes second temperature control means which in turn include a steam generator adapted to eject steam towards the second surface of the support, that is, the surface opposite to the surface of the movable support onto which the cast web is formed. In this way, the temperature at the second surface may be maintained substantially constant. Advantageously, the flow rate of the ejected stream can be measured and regulated. Preferably, superheated steam is used to reduce the moisture of the cast web.

Further, said second temperature control means may comprise, in said first drying section, a drying air generator to eject drying air towards said first surface. The provision of a drying air generator in the first drying section, and preferably also in all other sections if more than one drying section is present, allows to modify both the flow rate and the temperature of the drying air directed towards the cast web in order to optimize the process to the parameters of the cast web itself. Further, preferably a continuous feedback control is present, so that flow rate or temperature or both of the drying air ejected from the drying air generator can be modified depending on the value of temperature and moisture of the cast web in the first drying section.

Preferably, the free surface temperature of the cast web, that is the surface of the cast web not in contact with the support, has a value in the first drying section comprised between about 20 degrees Celsius and about 99 degrees Celsius. Preferably, the steam flow rate in the first drying section is comprised between about 80 kg/h and about 300 kg/h and the drying air temperature is preferably comprised between about 100 degrees Celsius and about 140 degrees Celsius.

Preferably, the moisture of said cast web exiting said first drying section is comprised between about 15 percent and about 25 percent.

More preferably, said cast web formed onto said movable support defines a central portion and two side portions, said side portions including each an edge of said cast web, and wherein said drying air generator in said first drying section is so configured that an uneven drying air stream is ejected towards said cast web, said drying air stream having a higher flow rate or higher temperature or both in a region including said central portion of said cast web than in a region including said side portions of said cast web. As already mentioned, the moisture or temperature or both at the sides of the cast web is generally lower than the moisture and temperature in the center of the cast web, because both heat exchange and air convection are enhanced at the sides of the cast web. In order to obtain a uniform cast web having substantially the same level of moisture or temperature or both, conditions that may reduce the number of defects in the end products, a non-homogeneous drying air flow distribution or a non-homogeneous temperature distribution of the drying air or both is generated.

Advantageously, the casting apparatus comprises a control unit adapted to receive a signal sent by one or more of the following sensors: a moisture sensor adapted to determine a moisture value of said cast web in said first drying section; a moisture sensor adapted to determine the moisture value of said cast web at the exit of said first drying section; a thickness sensor adapted to determine the thickness or the variations in thickness of said cast web before, in or at the exit of said first drying section; a temperature sensor adapted to determine the temperature of said cast web in said first drying section; a temperature sensor adapted to determine the temperature of said slurry in said casting box; a temperature sensor adapted to determine the temperature of said movable support at the casting box; a flow rate sensor to determine the flow rate of said slurry into said casting box. The formation of the cast web is a delicate process which determines the quality of the end product. Several parameters may be controlled to minimize the risk of a rejection of the homogenized tobacco web obtained by casting the slurry. For example, due to defects or a low tensile strength out of specification material could be formed. In particular, these process parameters are—among others —, the temperature, the moisture, the residence time and the viscosity of the slurry. Further, the temperature and the moisture of the cast web are relevant parameters to obtain a proper end moisture. It is known that the viscosity is indeed a function of the temperature, the moisture and the residence time of the slurry. Therefore, preferably, at least one of the viscosity, the temperature and the moisture content of the slurry is monitored with appropriate sensors, as well as at least one of the moisture, the temperature, the thickness of the cast web. Preferably, the sensor signals are used with a feedback loop for online signal processing and control to maintain the parameters within a set of predetermined ranges. For example, the process control may be influenced by appropriate process parameter changes, such as the amount of cooling, the temperature, the speed of the moving support, the amount of water introduced in the slurry, the amount of other compounds forming the slurry, the temperature of the drying air or the flow rate of the drying air in the drying station and combinations of the aforementioned process parameter changes and others. Preferably these parameters are checked by means of sensors either within the first drying section or at the exit of the same, or both. The exit of the drying section represents a location outside the first drying section and in proximity of the same in the direction of motion of the movable support.

More preferably, said control unit is adapted to command one or more of: a pump to change the flow rate of said slurry into said casting box; first temperature means to modify the temperature of said drum; second temperature means to modify the temperature of said drying air in said first drying section, or to modify the flow rate of said drying air in said first drying section, or to modify the temperature distribution or drying air flow rate distribution or both of said drying air in said first drying section, or to modify the flow rate of the steam; casting box temperature means to modify the temperature in said casting box to change the temperature of said slurry; in order to change their operating conditions depending on the signal received by said one or more sensors. Preferably, one or more feedback loops are present in the apparatus of the invention. The presence of an inhomogeneity in the thickness or in the moisture of the cast web of homogenized tobacco material, which can be reported by the sensor(s), implicitly indicates the presence of non-optimal casting conditions. These non-optimal casting conditions can be due to several factors, such as the density of the slurry outside of a preferred range, a level of moisture in the slurry outside of a preferred moisture range and others, an incorrect temperature of the drying air in the first drying section, an incorrect flow rate of the drying air in the drying section, an incorrect distribution of the temperature or flow rate of the drying air in the drying section, an incorrect temperature of the movable support at the casting box and others. Therefore, advantageously a plurality of sensors is used in order to obtain values of parameters which play a role in the casting and drying process. These values can then in turn be adjusted with the feedback loops, for example when the conditions of the casting or drying would cause the production of cast web to be outside of the desired specifications. The appearance of defects or non-uniformities or the shift of a parameter outside a standard pre-set range is detected by one or more sensors and a corresponding signal is sent to the central control unit. The central control unit may operate or command an actuator or motor or temperature control means in order to change the deviating process parameter or to modify one or more additional different parameters to correct the detected problem.

A preferred feedback loop is for example the measurement of the moisture of the cast web in the first drying section or at the exit of the first drying section, and depending on the value of said moisture, sending a control signal to said drying air generator in order to change a temperature of said drying air or a flow rate of said drying air or both depending on said moisture value.

Advantageously, the casting apparatus comprises a doctoring blade adapted to remove said cast web from said movable support at the exit of said first drying section. The movable support at the exit of the first drying section is turning back around a drum system towards the casting box, so that further slurry can be continuously cast. The moisture content of the cast web at the end of the first drying section is low enough to allow removing the cast web from the support and continuing the drying of the cast web in another support.

In a preferred embodiment, the casting apparatus comprises a second drying section, having independently controlled third temperature control means adapted to control a temperature or a flow rate or a temperature distribution or a flow rate distribution or any combination of the above of drying air in said second drying section. Drying is very important for obtaining a quality end product within the specification given. In particular, the drying of the cast web is preferably slow and without relatively high temperature differences. Therefore, it is preferred that the first drying section is followed by a second drying section. Preferably, the cast web is removed from the movable support of the first drying section by the doctoring blade and placed onto a second movable support which passes through the second drying section. Advantageously, the second movable support is a mesh. A mesh support allows the unobstructed access of a drying medium to the second surface of the cast web of homogenized tobacco that has been previously in contact with the first movable support Preferably, the second drying section is controlled independently from the first drying section, so that for example the temperature of the drying air or the flow rate of the drying air or both can be independently adjusted. In one embodiment, the second drying section includes third temperature control means which comprise drying air generator to eject drying air both towards the first and the second surface of the second movable support. In the second drying section therefore, no steam is produced. Advantageously, the temperature of the air in the second drying section is lower than the temperature of the air in the first drying section. The temperature of the drying air in the second drying section is preferably comprised between about 75 degrees Celsius and about 105 degrees Celsius both towards the first and the second surface of the second movable support. Said first and second drying stages are preferably arranged in series one after the other, said first stage upstream of said second stage in a direction of movement of said cast web.

In an embodiment, said first drying section is divided in a plurality of first drying stages, the temperature of the drying air, the flow rate, the temperature distribution and the flow rate distribution of drying air being independently controlled in each of the first and second drying stage. In order to lower the moisture of the cast web in steps, gently releasing humidity. Preferably, the first drying section does not have a constant temperature of the drying air, or a constant flow rate either of the drying air or of the steam through the whole length of the drying section. Further, also the temperature and flow rate distribution can be varied between stages of the first dryer. In this way the moisture can be removed from the cast web in a very controlled manner without subjecting the cast web to excessive temperature or moisture differences. Further drying sections may be provided as needed.

Advantageously, the casting apparatus further comprises a winding section to wind said cast web into a bobbin; and a cooling section downstream said first or second drying section and upstream said winding section. As mentioned, in order to properly dry the cast web, the drying is as homogeneous as possible as relatively "slow" speed. At the end of the drying process, performed by means of the first and second drying sections, the cast web is preferably wound in order to form one or more bobbins. Before the winding, preferably, the cast web exiting the second drying section is cooled down close to ambient temperature, for example to a temperature between about 15 degrees Celsius and about 30 degrees Celsius by fourth temperature control means. The cooling can be for example performed by means of a cooling air stream. The cooling air stream may be directed unevenly across the web, for example to compensate for a non-uniform temperature distribution of the cast web across its width. The bobbins are then moved to either a stocking place or to a cutting section where the cast web is cut in portion of smaller dimension.

Further advantages of the invention will become apparent from the detailed description thereof with no-limiting reference to the appended drawings.

Figure 1:
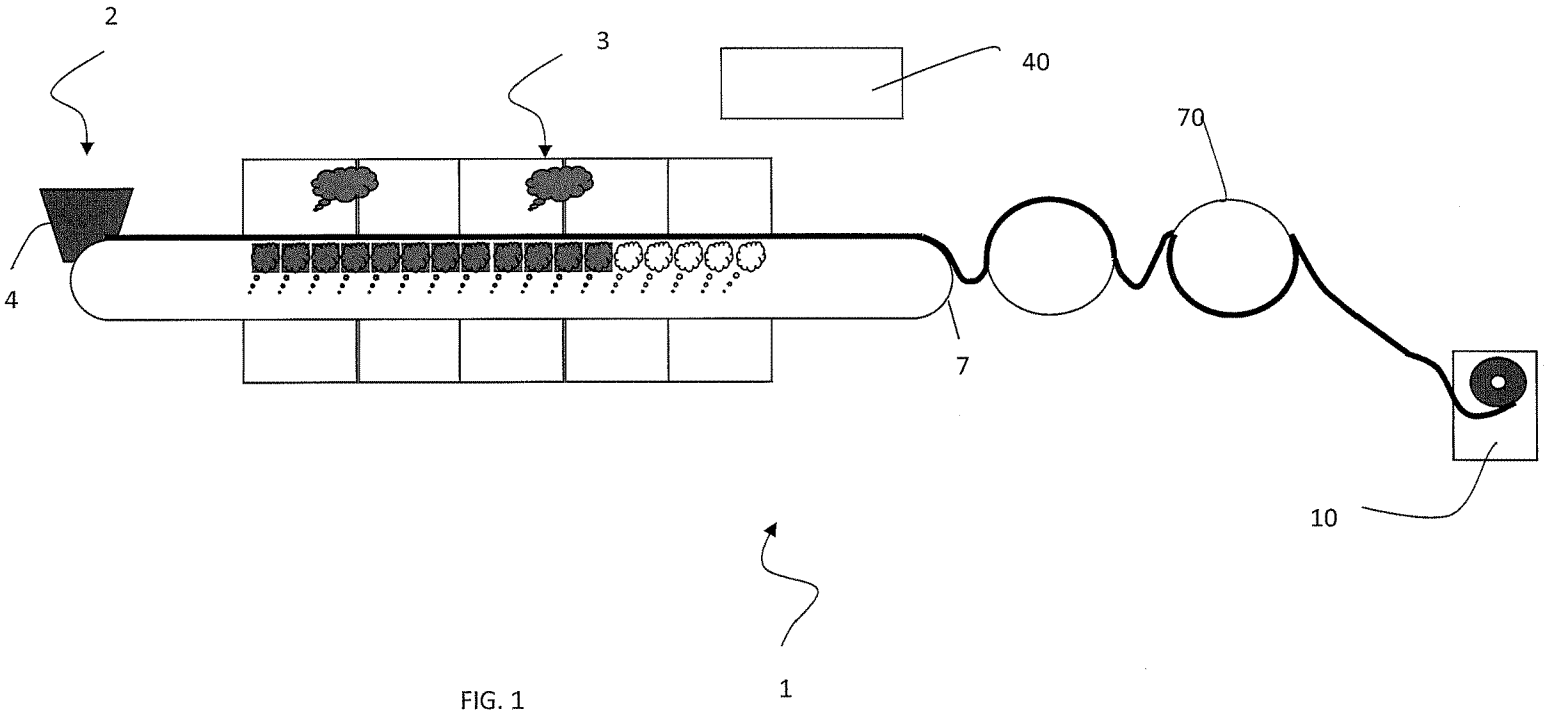
FIG. 1 is a schematic lateral view of an apparatus for the production of a homogenized tobacco web according to the invention.
Figure 2:
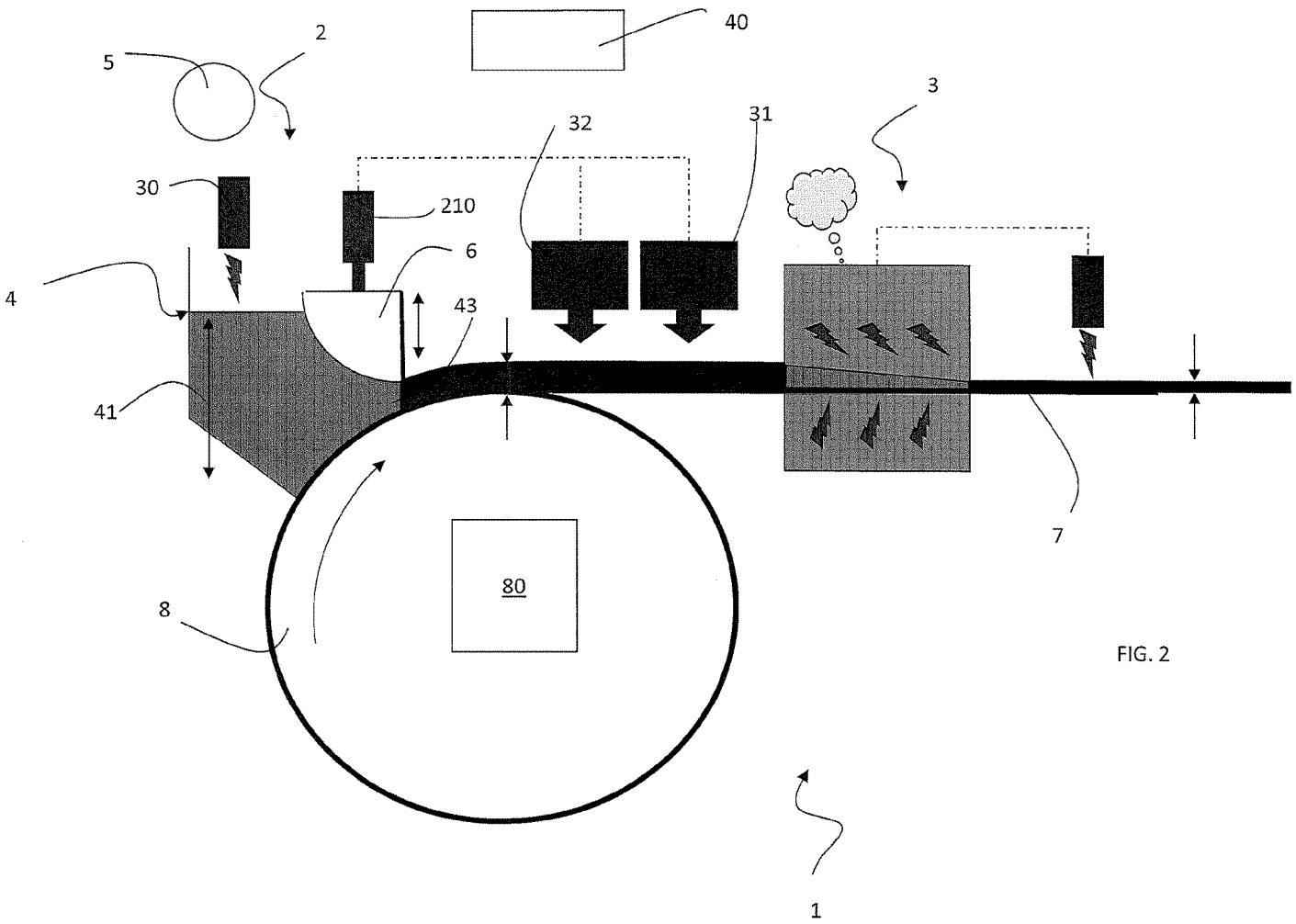
FIG. 2 is a schematic lateral view in section of a portion of the apparatus of FIG. 1.

With initial reference to FIGS. 1 and 2, an apparatus for the production of a web of homogenized tobacco material according to the present invention is represented and indicated with reference number 1.

The apparatus 1 for the production of a web of homogenized tobacco material includes a casting apparatus 2 and further also a drying apparatus 3 positioned downstream the casting apparatus 2 in the direction of motion of the web of homogenized tobacco material and a winding station 10 downstream the drying apparatus 3.

The casting apparatus 2 comprises a casting box 4 where slurry to form the web of homogenized tobacco material is introduced, a pump 5, a casting blade 6 and a first movable support 7. Casting box 4 may have any geometrical shape, and in the depicted embodiment it is substantially a prism. A temperature of the casting box can be varied in order to modify the temperature of the slurry, if needed, during the casting process, by means of a casting box control means (not shown in the appended drawings). The casting box 4 has an opening 43 in correspondence of its bottom and the opening extends along a width of the casting box, so that slurry can be cast from the casting box onto the movable support 7. Slurry from buffer tanks (not shown in the drawings) is transferred by means of the pump 5 into the casting box 4. Preferably pump 5 comprises a control (also not visible in the drawings) of flow rate to control the amount of slurry introduced in the casting box 4. Pump 5 is advantageously designed to ensure that slurry transfer times are kept to the minimum necessary.

Figure 3:
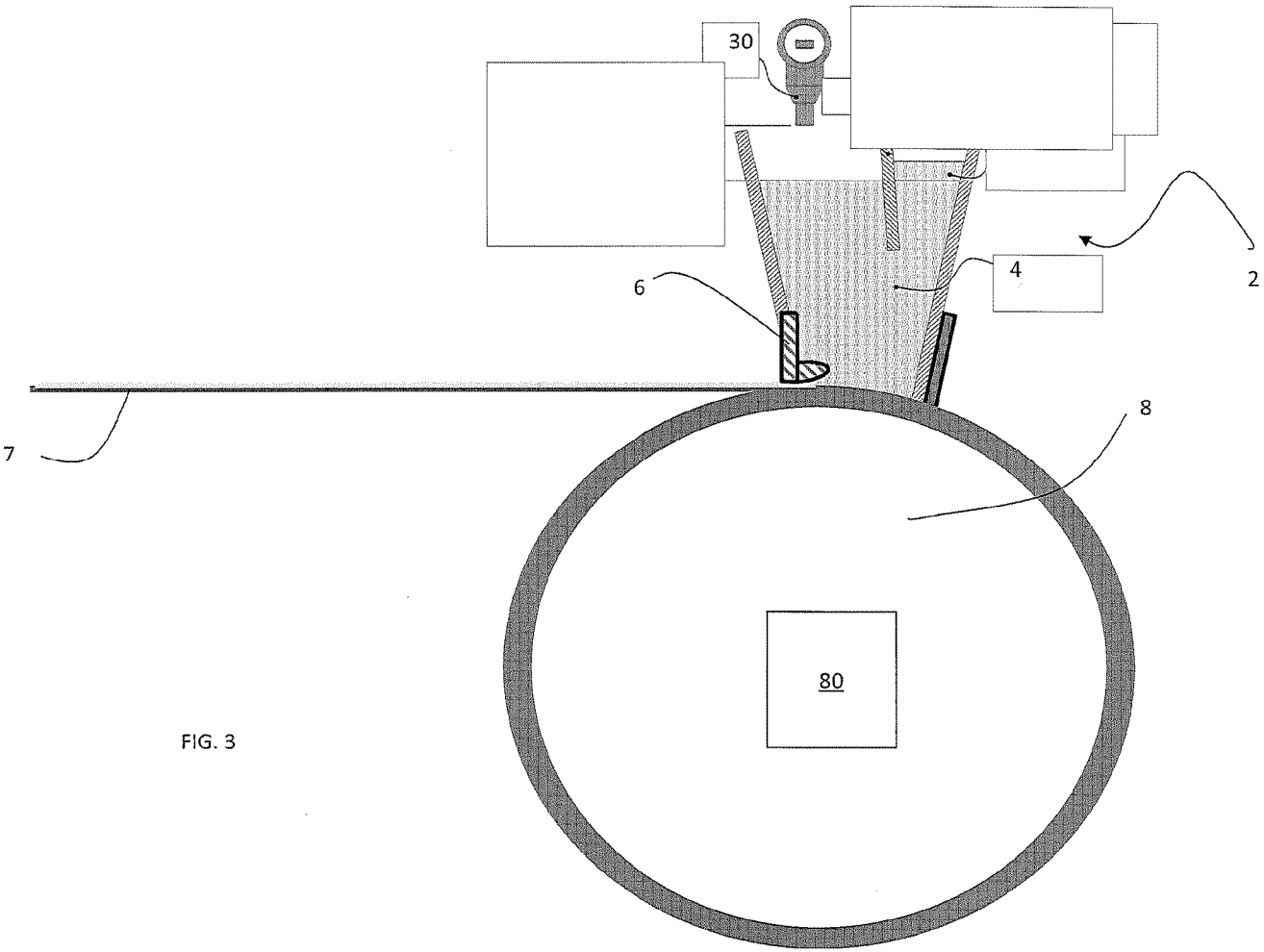
FIG. 3 is a schematic lateral view of a detail of the portion of the apparatus of FIG. 2.

Further, with reference to FIG. 3, the casting apparatus 2 includes the casting blade 6 fixed to the casting box 4 in order to cast the slurry. The casting blade 6 has a main dimension which is its width and it is fixed to the casting box 4 at or in proximity of its aperture 43 at the bottom. Preferably, the longitudinal width of the casting blade 6 is between about 40 cm and about 300 cm depending on the desired width of the cast web of slurry. Preferably, such width is adjustable, for example by means of suitable width adjusting means (not visible in the drawings), so that the width of the blade or the active volume of the casting box can be adjusted to the width of the web to be cast. The active volume of the casting box is the volume of the casting box that is actually filled with slurry.

The casting blade 6 is attached to the casting box 4 preferably by means of an adjustable board (not visible in the drawings) which allows a precise control of the position of the casting blade 6 to adjust a gap between the blade 6 and the support 7. The blade 6 can be moved in order to vary the dimension of the gap by means of actuators such as actuator 210 visible in FIG. 1.

The casting box 4 and the casting blade 6 are mounted above a drum 8 which rotates the movable support 7. Between the casting blade 6 and the movable support 7 the gap is present, the dimensions of which determine—among others—the thickness of the cast web of homogenized tobacco material.

The casting apparatus 2 also comprises the mobile support 7 on which the slurry is cast to form the web of homogenized tobacco material. The mobile support 7 comprises for example a continuous endless stainless steel belt 7 that is at least partially arranged around a drum assembly. The drum assembly includes a main drum 8 located below the casting box 4. The main drum 8 advances the movable support 7 by means of the rotation of the main drum 8. Preferably, the casting box 4 is mounted on top of the main drum 8. Preferably, the tolerances of the above mounting position are very strict, for example within about 0.01 mm. For example, the movable support drum 8 has a tolerance of below about 0.01 mm in concentricity and below about 0.10 mm across its diameter. Preferably, the movable support 7 has a tolerance of difference in height or thickness below about 0.01 mm.

Figure 4:
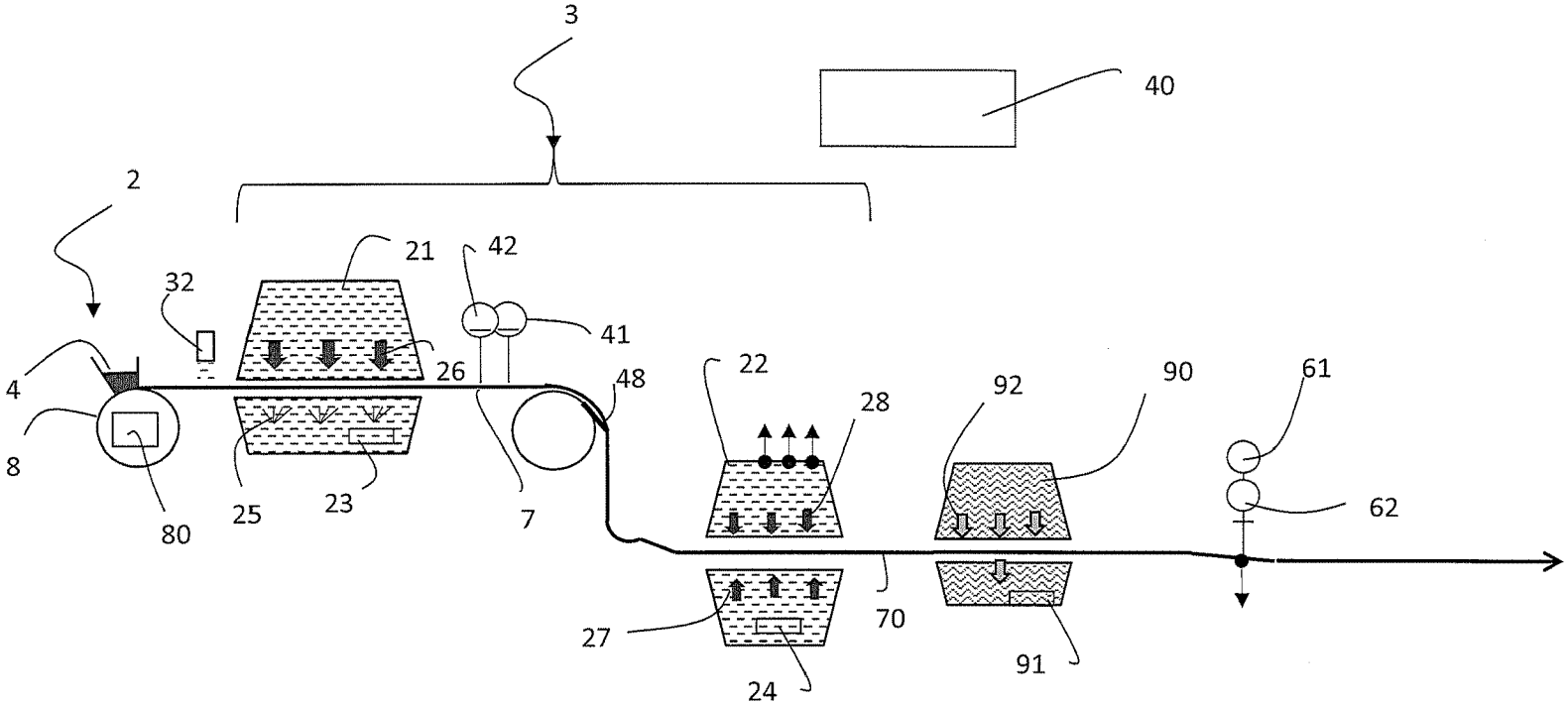
FIG. 4 is a more detailed lateral view of the portion of the apparatus of FIG. 2.

Preferably, the drum 8 includes a first temperature control device 80, schematically depicted by a box in the FIGS. 2, 3 and 4. The main drum 8 of the support 7 where the casting box 4 is located is preferably maintained at a constant temperature to minimize any changes to the slurry by the first temperature control device 80. First temperature control device 80 includes a water distributor (not shown in the drawings) so that the drum 8 is cooled or heated by means of water. For example, the first temperature control device 80 recirculate process water which is put in contact with the movable support 7 and the drum 8 on the return side. The drum 8 is in heat exchange with the support 7, in this case because the two are in contact. Preferably, the first temperature control device 80 controls the temperature of the drum 8 so that the difference between the temperature of the support 7 in the location where the slurry is deposited onto the support, that is at the casting box 4 substantially below aperture 43, and the temperature of the slurry is comprised between about 15 degrees Celsius and about 35 degrees Celsius. However, it may be desired that the drum 8 has a varying temperature profile across the drum 8. Preferably, such uneven temperature profile remains substantially constant over time during the production of the web of homogenized tobacco material. For example, the drum includes a mantle of a cylinder whose central part may be kept at a temperature between about 0.5 degrees Celsius and about 10 degrees Celsius lower than the remaining of the mantel of the drum 8. This variation is implemented so that the temperature of the moving support 7 is constant below aperture 43: the support 7 might reach the drum 8 with an non-homogeneous temperature distribution, and a corresponding non-homogeneous temperature distribution of the drum 8 in the opposite direction due to heat exchange modify the temperature distribution in the movable support is modified that the slurry when cast at the aperture 43 is subjected to a uniform temperature. The temperature of the support 7 is substantially similar to the temperature of the slurry present in the casting box 4.

Further, with again reference to FIG. 2, the casting apparatus 2 includes a plurality of sensors. A first sensor 30, a level sensor, is adapted to control the height 41 of the slurry within the casting box 4. This sensor 30 preferably measures a distance 42 between the sensor itself and the surface of the slurry in the casting box 4. The height 41 of the slurry is then derived from the known distance between the sensor 30 and the bottom of the casting box 4. Further, preferably a further sensor 32 is arranged above the movable support 7 to measure the weight per square centimeter of the homogenized tobacco layer on the movable support 7. The sensor 32 may be for example a nucleonic measuring head. Additional sensors are preferably present as well, such as a sensor 31 to locate and determine the positions of defects in the cast web of homogenized tobacco, a sensor to determine the moisture of the slurry and of the cast leaf at casting, and a temperature sensor for determining the temperature of the slurry in the casting box 4 (all other sensors than the numbered ones are not shown in the drawings).

Preferably, all the sensors send signals relative to their respective parameters to be measured (for example, temperature, moisture slurry level, presence and location of defects) to a central control unit 40. Central control unit 40 is preferably electrically connected to one, to some or to all of pump 5, adjustable board or to further circuits and actuators in the casting apparatus 2 or in a slurry preparation apparatus (not visible). In case the cast web reveals defects or inhomogeneity or the characteristics of the cast web are outside a preset range, the central control unit 40 can instruct changes in the process parameters and thus influence characteristics of the slurry or the parameters of the casting. These process parameters may be for example the dimension of the gap between the casting blade 6 and the support 7 or the amount of slurry in the casting box. Further, a control of the speed of the drum 8, and thus of the support 7, can be implemented as well.

As shown in FIG. 4, the drying apparatus 3 includes a first drying section 21 and a second drying section 22, separated one from the other and in series, with the first drying section disposed before the second drying section in the direction of movement of the cast web. Each of the first and second drying sections 21, 22 is preferably sub-divided in a plurality of individual drying zones. The first and the second drying sections 21, 22 include second temperature control device 23 and third temperature control devices 24. The second temperature control device 23 includes a steam generator 25, located below the movable support 7 to eject steam, preferably superheated steam, towards the bottom of the movable support 7. Further, the second temperature control device 23 includes a drying air generator 26 to eject drying air towards the cast web positioned onto the support 7 from above. The flow rate of both the steam and of the drying air is controllable and changeable. The temperature of the drying air can be modified as well. Further, preferably, each drying zone of the first drying section 21 preferably includes steam heating on the bottom side of the support and heated air above the movable support 7 and preferably also adjustable exhaust air control. The temperature and flow rate in each zone is preferably independently controlled. Preferably, the flow rate of the steam ejected by the steam generator 25 is comprised between about 80 kg/h and about 300 kg/h and the temperature of the drying air is comprised preferably between about 100 degrees Celsius and about 140 degrees Celsius.

Preferably, between the first and the second drying section 21, 22, a doctoring blade 48 is located, to remove the cast web from the first movable support 7 at the exit of the first drying section 21. The cast web from the first movable support 7 is laid onto a further second movable support 70. The first drying section 21 further comprises at its exit a moisture sensor 41 and a preferably also thickness sensor 42 to measure the moisture content and optionally also the thickness of the cast web. The values measured by these sensors are sent to the control unit 40, so that, in case these values are not within the preferred set ranges, the flow rate of the steam, or the flow rate of the drying air or the temperature of the drying air, combination of the above or others can be performed in order to have a feedback control. Alternatively or in addition, the flow distribution of the steam or of the drying air or the temperature distribution of the drying air can be modified. Alternatively, the control unit 40 may change different parameters, such as the temperature of the casting box, the viscosity of the slurry or other process parameters.

The second movable support 70, after the doctoring blade 48, passes through the second drying section 22. Preferably, also the second drying section 22 comprises a plurality of drying stages as the first drying section. Preferably, the number of stages in the second drying section 22 is less than the number of stages in the first drying section 21. The third temperature control device 24 includes first and second drying air generator 27, 28 to eject drying air towards the bottom of the movable support 70 and towards the cast web positioned onto the support 70, respectively. The flow rate of both drying air steams from above and below is controllable and changeable. The temperature of the drying air can be modified as well. Further, preferably, each drying zone in the second drying section 22 has independently controlled temperature and flow rate of the drying air, as well as of their temperature and flow rate distribution. Preferably, the temperature of the drying air in the second drying section 22 is comprised preferably between about 75 degrees Celsius and about 105 degrees Celsius.

At the exit of the second drying section 22, preferably a cooling section 90 is present. The second movable support 70 moves the cast web from the second drying section 22 to the cooling section 90, where the temperature of the cast web is reduced before winding the cast web into bobbins. The cooling section 90 includes a fourth temperature control device 91 which includes a cooling air generator 92 to eject cooling air towards the cast web. The purpose of the cooling section is mainly to reduce the temperature of the cast web to facilitate winding of the web of homogenized tobacco material.

At the exit of the cooling section 90, the apparatus 1 includes one or more sensor 61, 62, to measure the moisture of the cast web and the thickness of the same. The value(s) of moisture and thickness are preferably sent to the control unit 40 and appropriate feedback controls may become operative. For example, the temperature or the flow rate of the cooling air or drying air can be changed within the second drying section 22 or cooling section 90. Also, parameters of the slurry preparation and casting can be changed by appropriate algorithms and feedback loops.

At the end, a winding section 10 is provided, where the cast web is wound into bobbins.

Figure 5:
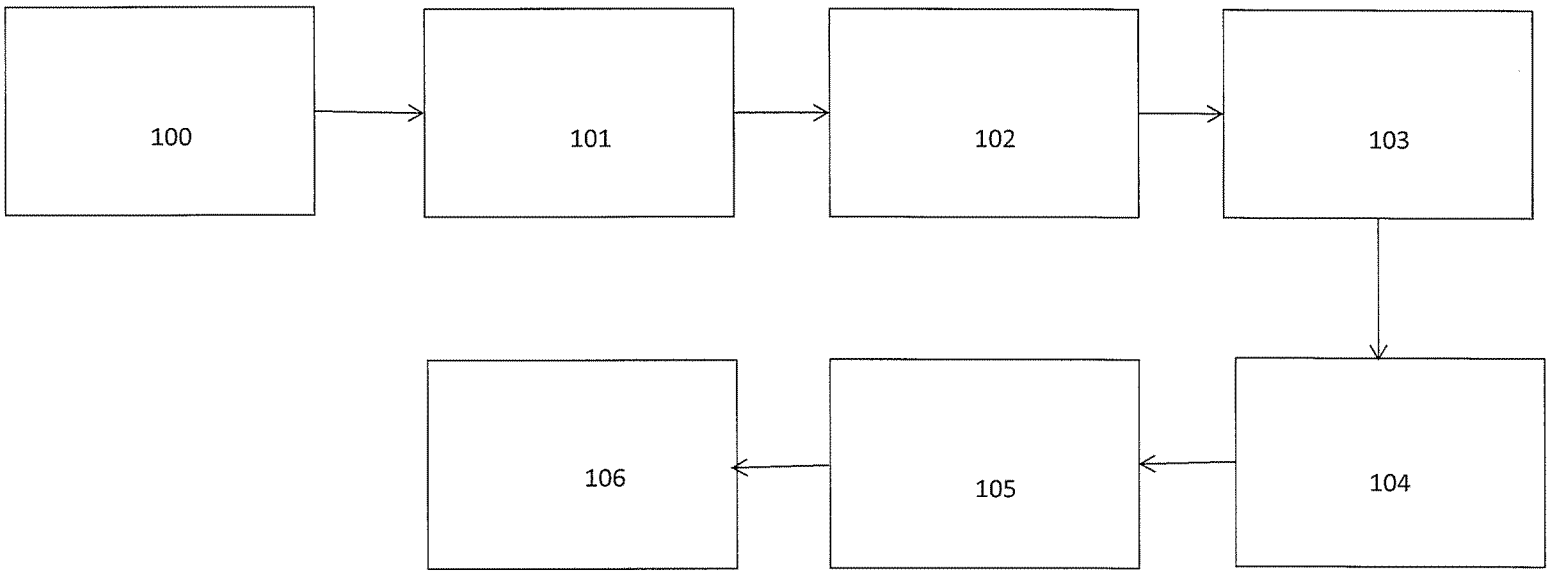
FIG. 5 is a flow diagram of a method of production of a homogenized tobacco web using the apparatus of the invention.

With now reference to FIG. 5, the functioning of the apparatus 1 including the casting apparatus 2 and drying apparatus 3 is as follows. A slurry, formed preferably by combining and mixing tobacco powder and other ingredients, is transferred from a holding tank (not shown) using for example in line mixers (also not shown) to the casting apparatus 2 inside the casting box 4. The step 100 of casting of the slurry into a web of homogenous and uniform film thickness is performed on the movable support 7, for example the stainless steel belt 7. The casting step 100 includes transferring the slurry from the mixing tank to the casting box 4. Further, the casting step 100 preferably includes monitoring the level of slurry in the casting box 4, the moisture of the slurry inside the casting box 4, the temperature of the slurry, and the density of the slurry, by means of suitable sensors, such as sensor 30.

The casting is performed by means of casting blade 6 forming a gap with the movable support 7. The gap dimensions can also be feedback controlled. The thickness of the web of homogenized tobacco material and grammage controlled by nucleonic gauge immediately after casting are continuously monitored and feedback-controlled using slurry measuring device.

Further, the cast web undergoes a first drying step 101 by means of the drying apparatus 3. The first drying step includes preferably a uniform and gentle drying of the cast web in an endless, stainless steel belt dryer with individually controllable zones. Preferably the drying step comprises monitoring the cast leaf temperature at each drying zone to ensure a gentle drying profile at each drying zone and heating the support where the homogenized cast sheet is formed. Preferably, the drying profile is a so called TLC drying profile. During the first drying step 101, a monitoring step 102 of the cast web temperature at each drying zone to ensure a gentle drying profile at each drying zone is preferably performed. The cast web is dried in the first drying step on the steel belt 7 with steam pan heating from bottom and top air drying. Every drying zone of the first drying section is equipped with steam flow and pressure control that the air temperature and air flow are fully adjustable to provide the desired drying profile and ensuring product residence time is respected. Preferably, the monitoring step 102 is executed to also measure the moisture content and number of defects present in the dried web at the end of the first drying step, as well as the thickness of the cast web.

Preferably, at the end of the casting step 100 and of the first drying step 101, the homogenized tobacco web is removed from the support 7. Doctoring 103 of the cast web after the first drying step at the right moisture content is preferably performed. Preferably, the cast web undergoes a second drying step 104 to remove further moisture content of the cast web to reach a moisture target. Preferably, in this second drying step 104, the cast web is laid onto a wire, such that moisture can be easily removed from both surfaces of the web. After the drying step 104, a cooling step is performed 105 and then the cast web is preferably wound in one or more bobbins in a winding step 106, for example to form a single master bobbin. This master bobbin may be then used to perform the production of smaller bobbins by slitting. The smaller bobbin may then be used for the production of an aerosol-generating article (not shown).

The invention claimed is:

1. Apparatus for production of cast web of homogenized tobacco material, said casting system comprising a casting box adapted to contain a slurry of said homogenized tobacco material and from which a cast web of said slurry may be cast;

a first drying section adapted to dry said cast web; a movable support to receive the cast web formed by casting said slurry from said casting box and to transport it to said first drying section;

a temperature-controlled drum adapted to move said movable support and adapted to allow heat exchange between said drum and said movable support, wherein the temperature of the drum is cooled;

so that a temperature difference between a temperature of said movable support at a position where said cast web is received onto said support from said casting box and a temperature of said slurry in said casting box is comprised between 0 degree Celsius and about 50 degrees Celsius.

2. Apparatus according to claim 1, further comprising a water distributor to cool said drum with water.

3. Apparatus according to claim 1, wherein said movable support includes an endless conveyor belt realized in stainless steel.

4. Apparatus according to claim 1, wherein the temperature of the drum is cooled so that a temperature of said movable support at a position where said cast web is received onto said movable support is comprised between about 15 degrees Celsius and about 50 degrees Celsius.

5. Apparatus according to claim 1, further comprising a steam generator in said first drying section and wherein said movable support defines a first and a second opposite surface, said slurry being cast onto said first surface, and wherein said a steam generator is configured to eject steam towards said second surface.

6. Apparatus according to claim 1, further comprising a drying air generator in said first drying section and wherein said movable support defines a first and a second opposite surface, said slurry being cast onto said first surface, and wherein said drying air generator is adapted to eject drying air towards said first surface.

7. Apparatus according to claim 6, wherein said cast web onto said movable support defines a central portion and two side portions, said side portions including each an edge of said cast web, and wherein said drying air generator in said first drying section is so configured that an uneven drying air stream is ejected towards said cast web, said air stream having a higher flow rate or higher temperature or both in a region including said central portion of said cast web than in a region including said side portions of said cast web.

8. Apparatus according to claim 1, comprising a control unit adapted to receive a signal sent by one or more of the following sensors:

a moisture sensor adapted to determine a moisture value of said cast web in said first drying section;

a moisture sensor adapted to determine the moisture value of said cast web at the exit of said first drying section;

a thickness sensor adapted to determine the thickness or the variations in thickness of said cast web before, in or at the exit of said first drying section;

a temperature sensor adapted to determine the temperature of said cast web in said first drying section;

a temperature sensor adapted to determine the temperature of said slurry in said casting box;

a temperature sensor adapted to determine the temperature of said movable support at the casting box;

a flow rate sensor to determine the flow rate of said slurry into said casting box.

9. Apparatus according to claim 8, wherein said control unit is adapted to effect one or more of the following:

change the flow rate of said slurry into said casting box;

modify the temperature of said drum;

modify the temperature of said drying air in said first drying section, or to modify the flow rate of said drying air in said first drying section, or to modify the temperature distribution or drying air flow rate distribution or both of said drying air in said first drying section, or to modify the flow rate of said steam; and modify the temperature in said casting box to change the temperature of said slurry;

in order to change their operating conditions depending on the signal received by said one or more sensors.

10. Apparatus according to claim 1, comprising a doctoring blade adapted to remove said cast web from said movable support at the exit of said first drying section.

11. Apparatus according to claim 1, comprising a second drying section in which a temperature or a flow rate or a temperature distribution or a flow rate distribution or any combination of the above of drying air in said second drying section are independently controlled.

12. Apparatus according to claim 11, wherein said first and second drying sections are arranged in series one after the other, said first stage upstream of said second stage in a direction of movement of said cast web.

13. Apparatus according to claim 1, wherein said first drying section is divided in a plurality of first drying stages, the temperature of the drying air and the flow rate of drying air being independently controlled in each first drying stage.

14. Apparatus according to claim 1, comprising:

a winding section to wind said cast web into a bobbin; and a cooling section downstream said first or second drying section and upstream said winding section in the direction of motion of said cast web.

15. Apparatus according to claim 14, wherein said cooling section includes a cooling air generator.

* * * * *